US007389901B2

(12) United States Patent
Cho et al.

(10) Patent No.: US 7,389,901 B2
(45) Date of Patent: Jun. 24, 2008

(54) NAILER WITH A SAFETY DEVICE

(75) Inventors: Bo-Seob Cho, Seoul (KR); Jong-Yeol Han, Gyeonggi-do (KR); Jin-Won Kim, Seoul (KR)

(73) Assignee: Jeil Tacker Co., Ltd, Gwangju-Si, Gyeonggi-Do (KR)

( * ) Notice: Subject to any disclaimer, the term of this patent is extended or adjusted under 35 U.S.C. 154(b) by 0 days.

(21) Appl. No.: 11/683,328

(22) Filed: Mar. 7, 2007

(65) Prior Publication Data

US 2008/0073403 A1 Mar. 27, 2008

(30) Foreign Application Priority Data

Sep. 21, 2006 (KR) ..... 10-2006-0091583

(51) Int. Cl.
*B25C 1/04* (2006.01)

(52) U.S. Cl. ..... 227/8; 227/120

(58) Field of Classification Search ..... 227/8, 227/120, 130, 142
See application file for complete search history.

(56) References Cited

U.S. PATENT DOCUMENTS 4,378,084 A * 3/1983 Scala ..... 227/8
4,566,619 A * 1/1986 Kleinholz ..... 227/8
4,821,937 A * 4/1989 Rafferty ..... 227/8
5,597,106 A * 1/1997 Hamano et al. ..... 227/8
5,662,257 A * 9/1997 Mukoyama et al. ..... 227/8
5,667,127 A * 9/1997 Ichikawa et al. ..... 227/142
5,669,541 A * 9/1997 Ronconi ..... 227/8
5,791,545 A * 8/1998 Lin ..... 227/8
6,213,372 B1 * 4/2001 Chen ..... 227/8
6,357,647 B1 * 3/2002 Ou ..... 227/8
6,866,177 B1 * 3/2005 Chen ..... 227/142
6,948,646 B2 * 9/2005 Huang ..... 227/8
6,966,476 B2 * 11/2005 Jalbert et al. ..... 227/8
6,974,062 B2 * 12/2005 Akiba ..... 227/8
7,137,540 B2 * 11/2006 Terrell et al. ..... 227/8
7,143,918 B2 * 12/2006 Aguirre et al. ..... 227/8

* cited by examiner

*Primary Examiner*—Scott A. Smith
(74) *Attorney, Agent, or Firm*—GWiPS

(57) ABSTRACT

Disclosed herein is a nailer having an improved safety device. With the improved safety device, a movable plate, which is adapted to slidably move along a lower surface of a guiding unit, is formed, at a certain location thereof, with an insertion hole for the insertion of a protrusion formed at a trigger. Thereby, if the trigger is pulled in a pressed state of the movable plate, a nailing operation is accomplished. Also, in the course of pulling the trigger, the movable plate can be further inserted rearward by a predetermined distance under interaction of the insertion hole and protrusion. This has the effect of eliminating the risk of causing scratches on a nailing surface of a target structure even if the movable plate is moved while coming into close contact, at a front end thereof, with the nailing surface, resulting in several advantages, such as for example, easy nailing operation, operator's convenient working posture, and rapid and safe nailing operation.

5 Claims, 16 Drawing Sheets

NAILER WITH A SAFETY DEVICE

This application is based on and claims priority to Korean Patent Application No. 10-2006-0091583 filed on Sep. 21, 2006 in the Korean Intellectual Property Office (KIPO), the entire contents of which are hereby incorporated by reference.

BACKGROUND OF THE INVENTION

1. Field of the Invention

The present invention relates to a nailer having an improved safety device, and, more particularly, to a nailer having an improved safety device wherein a movable plate, which is adapted to slidably move along a lower surface of a guiding unit, is formed, at a certain location thereof, with an insertion hole for the insertion of a protrusion formed at a trigger, so as to be moved rearward by a predetermined distance under interaction of the insertion hole and protrusion while allowing implementation of a nailing operation when the trigger is pulled in a pressed state of the movable plate, thereby eliminating the risk of causing scratches on a nailing surface of a target structure even if the movable plate is moved while coming into close contact, at a front end thereof, with the nailing surface and consequently, resulting in several advantages, such as for example, easy nailing operation, operator's convenient working posture, and rapid and safe nailing operation.

2. Description of the Related Art

As well known, nailing machines are designed to attach a variety of articles, such as furniture, fabrics, etc., to specific target structures. The nailing machines include a variety of sub-categories on the basis of the kinds of projectile objects used therein. Examples of the nailing machines include a pneumatic tacker, stapler, nailer, pinner, and the like. Generally, the nailing machines serve to attach a variety of materials, such as thin wood boards, fabrics, and the like, to fixed structures made of wood, soft plastics, or the like, by use of pins, staples, tacks, and nails. Nowadays, The nailing machines are widely used by virtue of their several advantages of rapid and convenient use, strong attachment force, etc.

FIG. 1 is a side view illustrating a nailing machine having a safety device according to an exemplary embodiment of the prior art.

Referring to FIG. 1, the conventional nailing machine 2 is of a pneumatic tacker type in which a piston is fitted in a cylinder (not shown) and adapted to be operated by compressed air, so as to hit tacks with a hitting rod (so called "piston driver") thereof. In the shown conventional pneumatic tacker, the size and shape of a tack ejection port as well as the cross sectional area and shape of a hitting surface portion provided at the hitting rod are selected to coincide with the area and shape of a horizontal push portion of tacks.

Specifically, the conventional nailing machine 2 includes, within a body 4 thereof, a mechanism for generating compressed air required to advance the hitting rod. The body 4 is provided at a rear end thereof with a body cover 6. A magazine 8 is coupled to a front portion of the body 4 at a lower end of the front portion and used to charge a plurality of tacks therein. Also, a guiding unit 16 is provided at an upper end of the magazine 8 and connected to the front portion of the body 4. If tacks are successively raised from the magazine 8, the guiding units 16 allows the tacks to be launched under the action of compressed air.

The magazine 8 is provided at a lower end thereof with a latch 10 to keep the magazine B at a fixed position. The body 4 is provided at a rear portion thereof with a handle 12. The handle 12 extends vertically from a lower end of the rear portion of the body 4. A lower end of the handle 12 is secured to the latch 10 by means of a bracket 14.

A trigger 13 of the conventional nailing machine 2 is provided at a corner of an inner connecting portion between the body 4 and the handle 12. With the manipulation of the trigger 13, tacks can be launched from the nailing machine 2.

In operation of the nailing machine 2 having the above described configuration, if compressed air is introduced into the cylinder to apply a certain pressure to the piston fitted in the cylinder, the piston is advanced to push out tacks, pins, staples, or the like charged in the magazine 8, thus allowing the tacks, etc. to be launched to desired positions by way of the guiding unit 16 in this case, a plunger 29 is mounted in the handle 12 to come into contact with the trigger 13, to impart an opening pressure to the cylinder.

When using the above described conventional nailing machine 2, however, it should be noted that the nailing machine 2 has the risk of fatal accidents if long or large projectile objects including tacks, nails, etc. are launched to unwanted target structures by unintentional trigger pulling manipulation.

To solve the above problem, most conventional large-scale nailing machines, which are designed to launch long projectile objects, such as tacks, nails, etc., have a separate safety device. The safety device serves to allow the trigger 13 to be manually operated only under specific conditions while preventing unintentional launch of projectile objects even when the trigger 13 is pulled.

Conventionally, two types of safety devices have been used in nailing machines. A first type of safety device is provided at a lower surface of the guiding unit 16 so that a contact surface portion thereof is partially exposed to the outside from a front end of the guiding unit 16. Thereby, only when the exposed contact surface portion of the safety device is pressed in a pulled state of the trigger 13, the launch of projectile objects is allowed.

A second type of safety device is adapted to allow the launch of projectile objects only when the trigger 13 is pulled in a state wherein the exposed contact surface portion of the safety device is pushed by a nailing surface of a target structure. The first type of safety device is used when it is required to perform a rapid continuous nailing operation, while the second type of safety device is used when it is required to perform an accurate nailing operation. Meanwhile, it is noted that the above described safety devices have not been used in most small-scale nailing machines.

The above described safety device may be configured to have various configurations, and one example of the various configurations will now be described with reference to FIG. 1. As shown in FIG. 1, the safety device takes the form of an L-shaped movable plate 18, which is forwardly and rearwardly slidable along the lower surface of the guiding unit 16 and adapted to be pressed by the trigger 13. The movable plate 18 acts to allow the trigger 13 to be pulled only when a front end thereof is pressed by a target structure. Accordingly, to accomplish a nailing operation, the movable plate 18 is first positioned to be pressed by the target structure and then, the trigger 13 is pulled. The above described type of safety device shows approximately the same operational manner as in conventional nailing machines shown in FIGS. 1 to 3, except for the fact that the nailing machine shown in FIG. 1 uses a safety device in the form of an L-shaped iron plate, the nailing machine shown in FIG. 2 uses a safety device in the form of an iron wire, and the nailing machine shown in FIG. 3 has an auxiliary trigger as a safety device.

When using the above described safety device, however, since the trigger 13 can be pulled to accomplish a nailing operation only after the movable plate 18 is pressed by the target structure, the conventional nailing machine 2 has problems of inconvenient nailing operation and excessively long nailing time. Furthermore, if the movable plate 18 is moved in a state wherein a front end thereof is pressed by the target structure, there is the risk of imparting scratches to the target structure. Meanwhile, not described reference numeral 20 in FIG. 1 designates an auxiliary lever for achieving rapid opening of a guide cover when tacks are jammed in the guiding unit 16.

Referring to FIG. 2, there is shown a nailing machine having a safety device according to another embodiment of the prior art. The nailing machine 22 comprises the body 4, magazine 8, and guiding unit 16 similar to the above described nailing machine 2 of FIG. 1, but the trigger 13 of the nailing machine 22 is installed to be spaced apart forward from the plunger 29. In this case, an inner trigger piece 28 is provided in a rear end portion of the trigger 13 so that a lower end of the inner trigger piece 28 is coupled to a lower end of the trigger 13.

The nailing machine 22 further comprises a movable wire 24 serving as a safety device. The crooked movable wire 24 has a crooked front end to be inserted into the guiding unit 16 and an L-shaped rear end adapted to press the inner trigger piece 28.

In operation of the above described nailing machine 22, if the front end of the movable wire 24 is pressed by the target structure in a state wherein the trigger 13 is pulled on the basis of a trigger hinge shaft 26 to accomplish a nailing operation, the rear end of the movable wire 24 acts to cause the inner trigger piece 28 to come into close contact with the plunger 29 as the movable plate 24 is moved rearward, thus imparting a pressure force to the inner trigger piece 28. With the pressure force, the inner trigger piece 28 presses the plunger 29, causing the launch of certain projectile objects, such as nails, tacks, pins, or the like.

If the front end of the movable wire 24 serving as the safety device is pressed by the target structure in a state wherein the trigger 13 is not pulled on the basis of the trigger hinge shaft 26, the rear end of the movable wire 24 does not cause the inner trigger piece 28 to come into close contact with the plunger 29 even if the movable wire 24 is moved rearward. In a state wherein the inner trigger piece 28 does not come into close contact with the plunger 29, there is no launch of nails, tacks, pins, or the like.

However, the above described conventional nailing machine 22 also has a problem in that it may cause scratches on the target structure if the movable plate 24 is moved in a state wherein the front end thereof is pressed by the target structure.

Referring to FIG. 3, there is shown the configuration of a safety device mainly used in small-scale nailing machines. As shown in FIG. 3, a conventional small-scale nailing machine 30 comprises the body 4, magazine 8, guiding unit 16, latch 10, handle 12, plunger 29, and body cover 6 similar to the above described nailing machine 2 of FIG. 1. A differentiated feature of the nailing machine 30 is to install an auxiliary trigger 32 as a safety device and a leaf spring 34 to continuously apply a restoration force to the auxiliary trigger 32. The leaf spring 34 is connected to the handle 12 to come into close contact with a lower surface of the trigger 13. The auxiliary trigger 32 is located below the trigger 13 and adapted not to be rotated by a pressure force applied by the trigger 13. In this case, only when the trigger 13 is pulled in a state wherein the auxiliary trigger 32 is rotated by a separate manual force, the nailing machine 30 can accomplish a nailing operation.

Accordingly, to accomplish a nailing operation, the auxiliary trigger 32 has to be pulled rearward prior to pulling the trigger 13. If the trigger 13 is pulled without pulling the auxiliary trigger 32, the lower surface of the trigger 13 comes into contact with an upper end of the auxiliary trigger 32. Accordingly, the trigger 13 cannot be pulled further, and therefore, no nailing operation is accomplished.

When using the auxiliary trigger 32, however, since the operator has to pull the trigger 13 with the first finger in a state of pulling the auxiliary trigger 32 with the second finger, it can be said that the auxiliary trigger 32 actually has less safety effect and has a high risk of causing an unintentional nailing operation. Accordingly, the nailing machine 30 using the auxiliary trigger 32 as a safety device suffers from a rate of accidents.

SUMMARY OF THE INVENTION

Therefore, the present invention has been made in view of the above problems, and it is an object of the present invention to provide a nailer having an improved safety device wherein a movable plate, which is adapted to slidably move along a lower surface of a guiding unit, is formed, at a certain location thereof, with an insertion hole for the insertion of a protrusion formed at a trigger, so as to be moved rearward by a predetermined distance under interaction of the insertion hole and protrusion while allowing implementation of a nailing operation when the trigger is pulled in a pressed state of the movable plate, thereby eliminating the risk of causing scratches on a nailing surface of a target structure even if the movable plate is moved while coming into close contact, at a front end thereof, with the nailing surface and consequently, resulting in several advantages, such as for example, easy nailing operation, operator's convenient working posture, and rapid and safe nailing operation.

In accordance with an aspect of the present invention, the above and other objects can be accomplished by the provision of a nailer comprising a body, a magazine, a guiding unit, a latch, a handle, a plunger, a body cover, and a trigger, further comprising a safety device coupled to the nailer to slidably move along a lower surface of the guiding unit, the safety device having a rear end coupled orthogonally to the trigger to be inserted into the trigger, so as to control operation of the trigger.

Preferably, the safety device may comprise a multiply-bent movable plate coupled to the nailer to slidably move along the lower surface of the guiding unit, a contact portion may be formed at a front end of the movable plate and adapted to come into contact with a target structure, an elongated hole may be perforated in a central location of the movable plate so that a screw is fastened therethrough in order to limit a movement distance of the movable plate, a retardant portion may be formed at a rear end of the movable plate to extend parallel to the ground, and an insertion hole may be perforated in a central location of the retardant portion.

Preferably, the trigger may comprise a trigger body configured to be caught by the operator's finger, an insertion hole may be perforated in a front portion of the trigger body at a position close to an upper end of the front portion, to allow the retardant portion of the movable plate to be inserted therethrough, a control protrusion may be formed at an inner periphery of the insertion hole at an upper end position of the inner periphery, the control protrusion being adapted to be inserted into the insertion hole perforated in the movable plate, shaft holes may be perforated through opposite side portions of the trigger body at upper end positions of the side portions, and an inner trigger piece is coupled in a rear end portion of the trigger and adapted to press the plunger if it is pressed by the trigger.

Preferably, the control protrusion may be configured to protrude forward from the trigger body by a predetermined angle, whereby, if the trigger is fully pulled after the control protrusion of the trigger is inserted into the insertion hole perforated in the movable plate, the control protrusion causes the movable plate to be further pulled toward the handle by a predetermined distance, thereby preventing the contact portion of the safety device from causing scratches on the nailing surface even if the nailer is moved in a state wherein a front end of the guiding unit included in the nailer comes into close contact with the nailing surface.

Preferably, the insertion hole may have a rounded inner surface to allow the control protrusion to be inserted along the rounded surface.

Preferably, an insertion recess may be formed in the retardant portion of the movable plate, to allow the control protrusion to be inserted thereinto.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Now, preferred embodiments of the present invention will be described with reference to the accompanying drawings.

Figure 1:
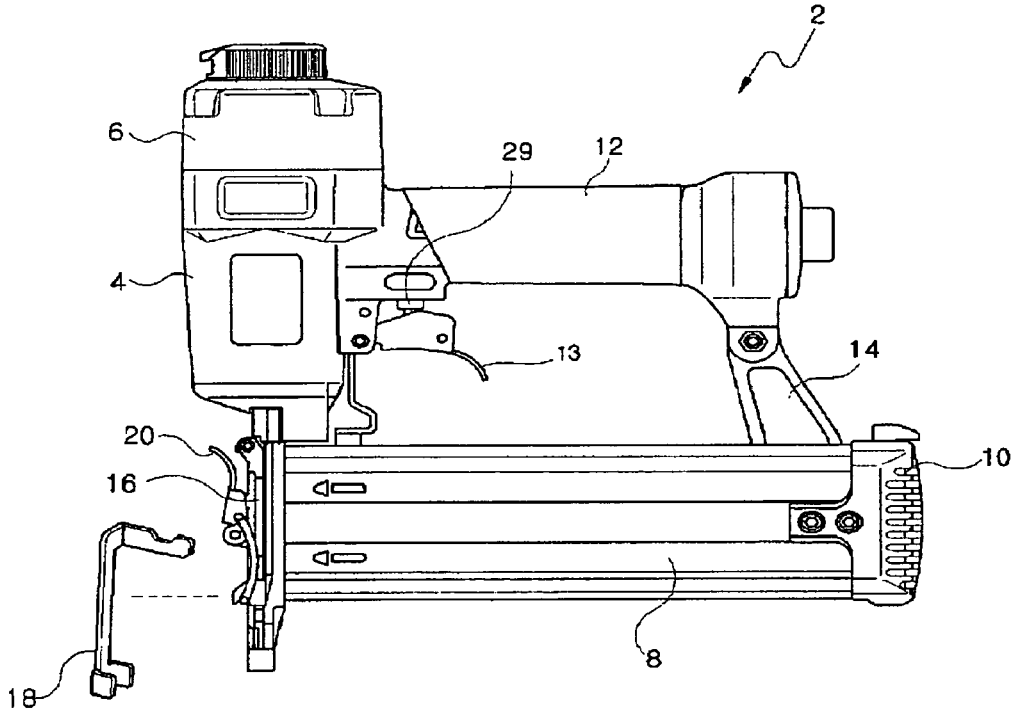
Fig. 1 (Prior Art)
FIG. 1 is a side view illustrating a nailing machine having a safety device according to an embodiment of the prior art.
Figure 2:
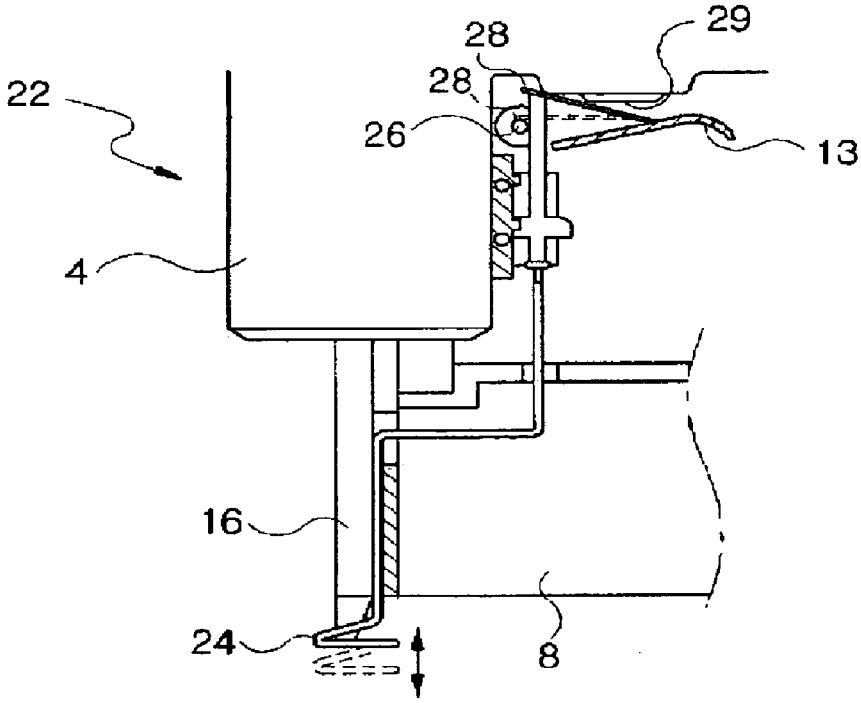
Fig. 2 (Prior Art)
FIG. 2 is a partial side view illustrating a nailing machine having a safety device according to another embodiment of the prior art.
Figure 3:
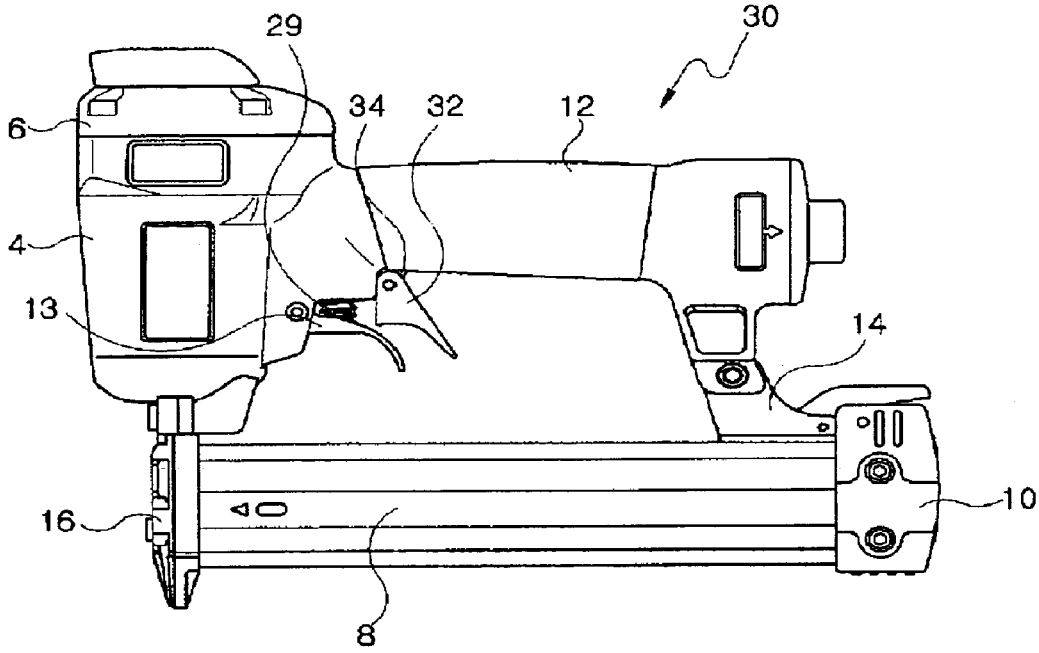
Fig. 3 (Prior Art)
FIG. 3 is a side view illustrating a nailing machine having a safety device according to yet another embodiment of the prior art.
Figure 4A:
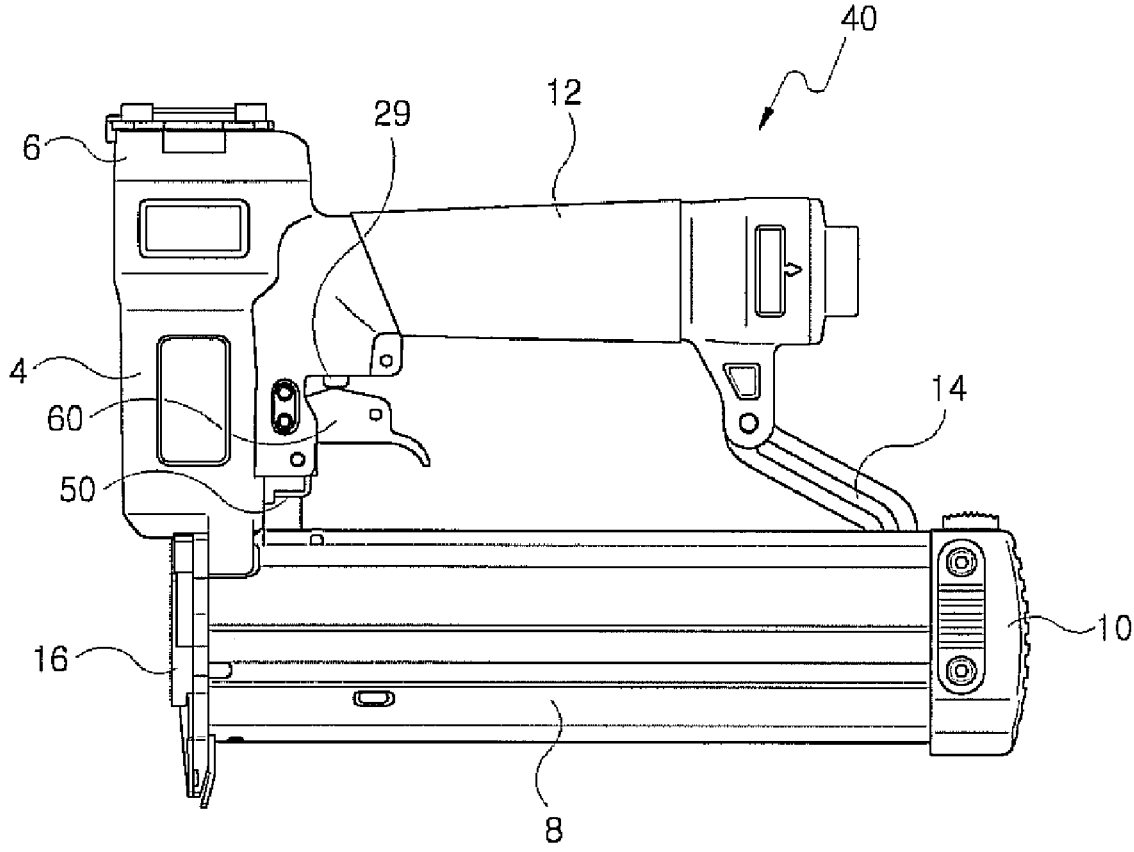
FIGS. 4A and 4B are side views illustrating a nailer having an improved safety device according to a first embodiment of the present invention.
Figure 4B:
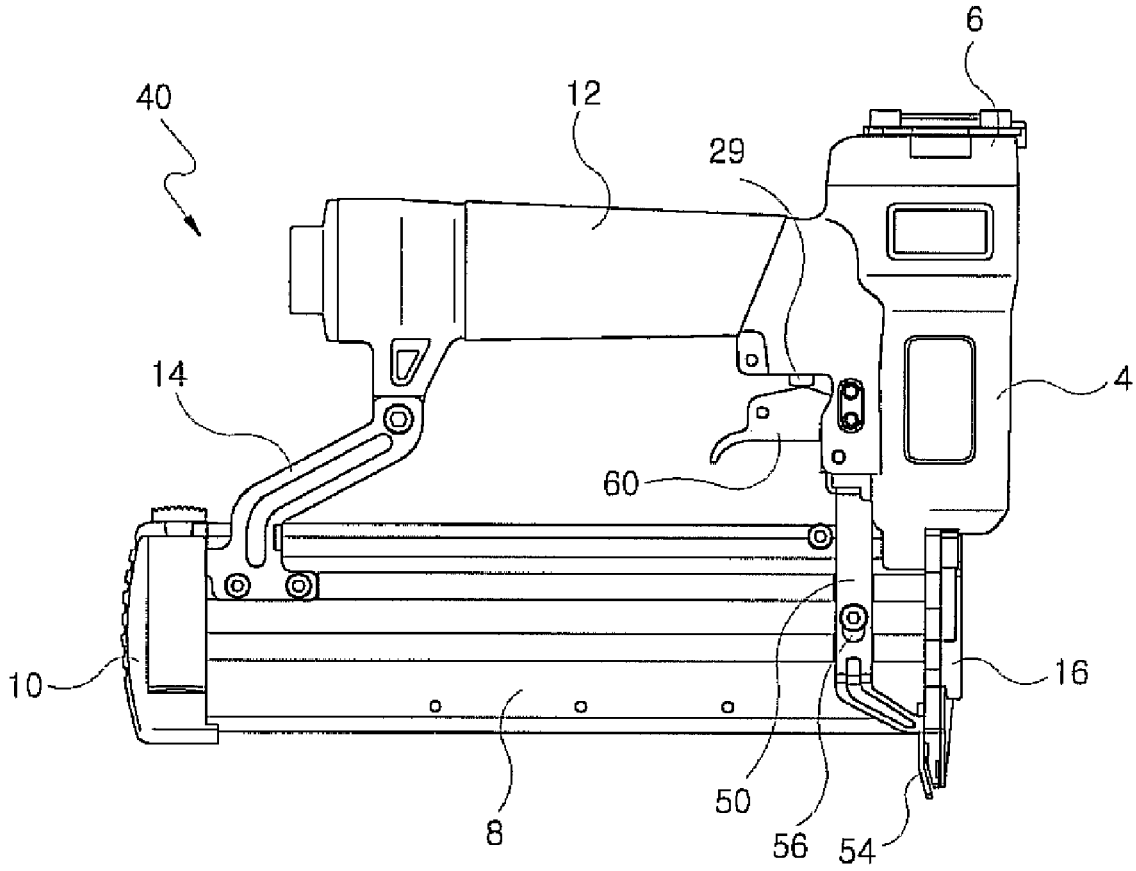
Figure 5:
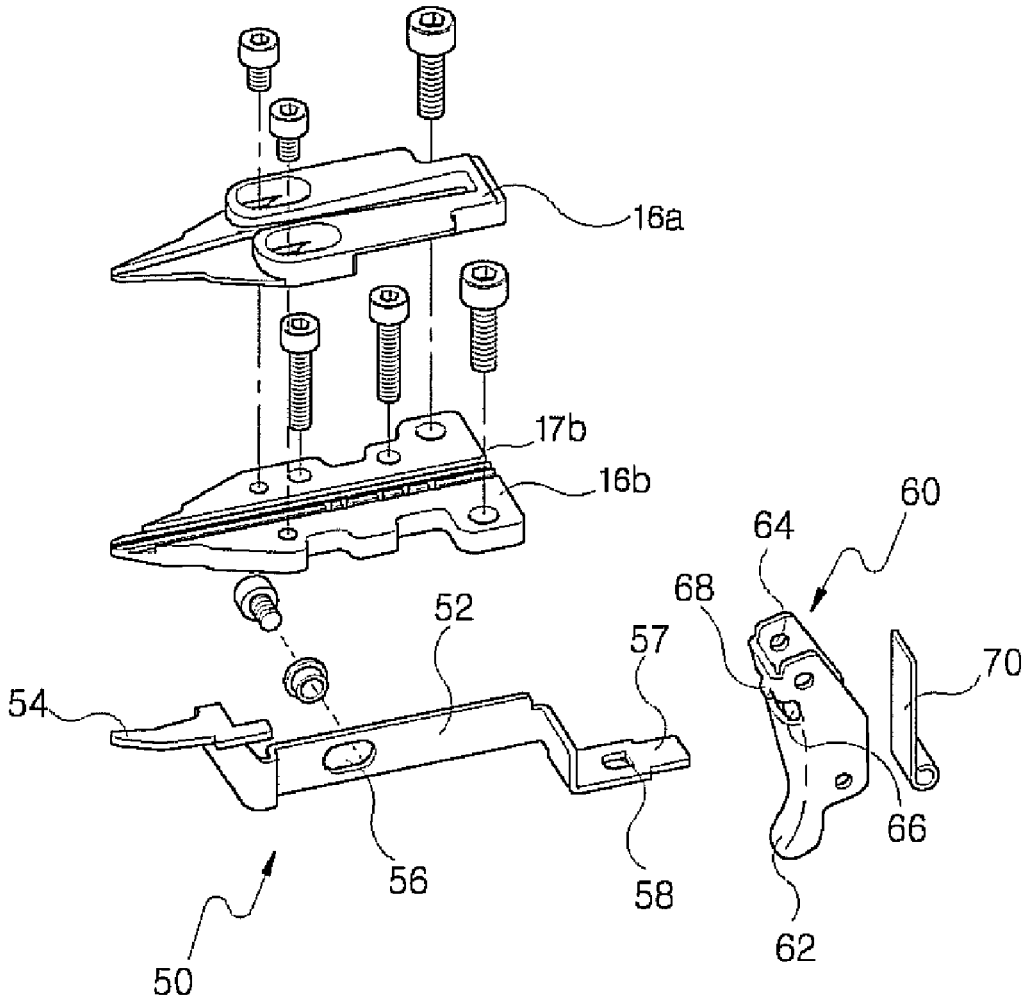
FIG. 5 is an exploded perspective view illustrating the coupling relationship of important parts provided in the nailer having an improved safety device according to the first embodiment of the present invention.

FIGS. 4A and 4B are side views illustrating a nailer having an improved safety device according to a first embodiment of the present invention. FIG. 5 is an exploded perspective view illustrating the coupling relationship of important parts provided in the nailer having an improved safety device according to the first embodiment of the present invention.

Referring to the drawings, the nailer 40 having an improved safety device according to the first embodiment of the present invention has a feature in that a movable plate, which is adapted to slidably move along a lower surface of a guiding unit, is perforated, at a predetermined portion thereof, with an insertion hole for the insertion of a protrusion formed at a trigger, so as to be moved rearward by a predetermined distance under interaction of the insertion hole and protrusion while allowing implementation of a nailing operation when the trigger is pulled in a pressed state of the movable plate, thereby eliminating the risk of causing scratches on a nailing surface of a target structure even if the movable plate is moved while coming into close contact, at a front end thereof, with the nailing surface, resulting in several advantages, such as for example, easy nailing operation, operator's convenient working posture, and rapid and safe nailing operation.

For this, the nailer 40 having an improved safety device according to the first embodiment of the present invention comprises the body 4, magazine 8, guiding unit 16, latch 10, handle 12, plunger 29, and body cover 6 in the same manner as the above described conventional nailer. Also, as an outstanding feature of the present invention, the nailer 40 further comprises a safety device 50, which is coupled to slidably move along a lower surface of the guiding unit 16 forward and rearward, and has a rear end inserted into a trigger 60 so as to control operation of the trigger 60.

The safety device 50, as shown in FIG. 5, includes a multiply-bent movable plate 52 coupled to the nailer 40 to slidably move along the lower surface of the guiding unit 16. The movable plate 52 is provided, at a front end thereof, with a contact portion 54 adapted to come into contact with a target structure and at a rear end thereof, with a retardant portion 57 that extends parallel to the ground. The retardant portion 57 is centrally perforated, at a predetermined position thereof, with an insertion hole 58. The movable plate 52 is also formed, at a predetermined central portion thereof, with an elongated hole 56, such that a screw is fastened through the elongated slot 56 for the purpose of limiting a movement distance of the movable plate 52.

Meanwhile, the trigger 60, which is controlled in rotation by the safety device 50, includes a trigger body 62 having a configuration suitable to be caught by the operator's finger. The trigger body 62 is perforated through a front portion thereof, at a position close to an upper end of the front portion, with an insertion hole 66, to allow the retardant portion 57 formed at the movable plate 52 to be inserted therethrough. A control protrusion 68 is formed at an inner periphery of the insertion hole 66 at an upper end of the inner periphery so that it is inserted into the insertion hole 58 perforated in the movable plate 52. The trigger body 62 is also perforated through opposite side portions thereof, at upper end positions of the side portions, with shaft holes 64. An inner trigger piece 70 is coupled in the trigger 60 and adapted to press the plunger 29 if it is pressed by the trigger 60.

In the above described configuration, the control protrusion 68 protrudes forward from the trigger body 62 by a predetermined angle to be inserted into the insertion hole 58 perforated in the movable plate 52. Accordingly, if the trigger 60 is fully pulled after the control protrusion 68 of the trigger 60 is inserted into the insertion hole 58 of the movable plate 52, the control protrusion 68 acts to further pull the movable plate 52 toward the handle 12.

With the movement of the movable plate 52, even if the nailer 40 is moved in a state wherein a front end of the guiding unit 16 provided at the nailer 40 comes into close contact with the nailing surface of the target structure, there is no risk of causing scratches on the nailing surface by the contact portion 54 of the safety device 50.

The movable plate 52 of the safety device 50 is coupled to the nailer 40 below the lower surface of the guiding unit 16 as shown in FIG. 4B, such that it is slidable forward and rearward as the contact portion 54 thereof is pressed by or released from the target structure. The guiding unit 16 consists of an upper guide 16*a* and a lower guide 16*b*, and each of the upper and lower guides 16*a* and 16*b* is longitudinally formed, along a central axis thereof, with a slide groove 17*b* for the movement of a hitting rod (not shown). The movable plate 52 is coupled to an upper end of the magazine 8 below the lower surface of the guiding unit 16 as a screw is fastened through the elongated hole 56 thereof.

Hereinafter, the function and operation of the nailer having the improved safety device according to the first embodiment of the present invention will be explained in detail with reference to the accompanying drawings.

Figure 6A:
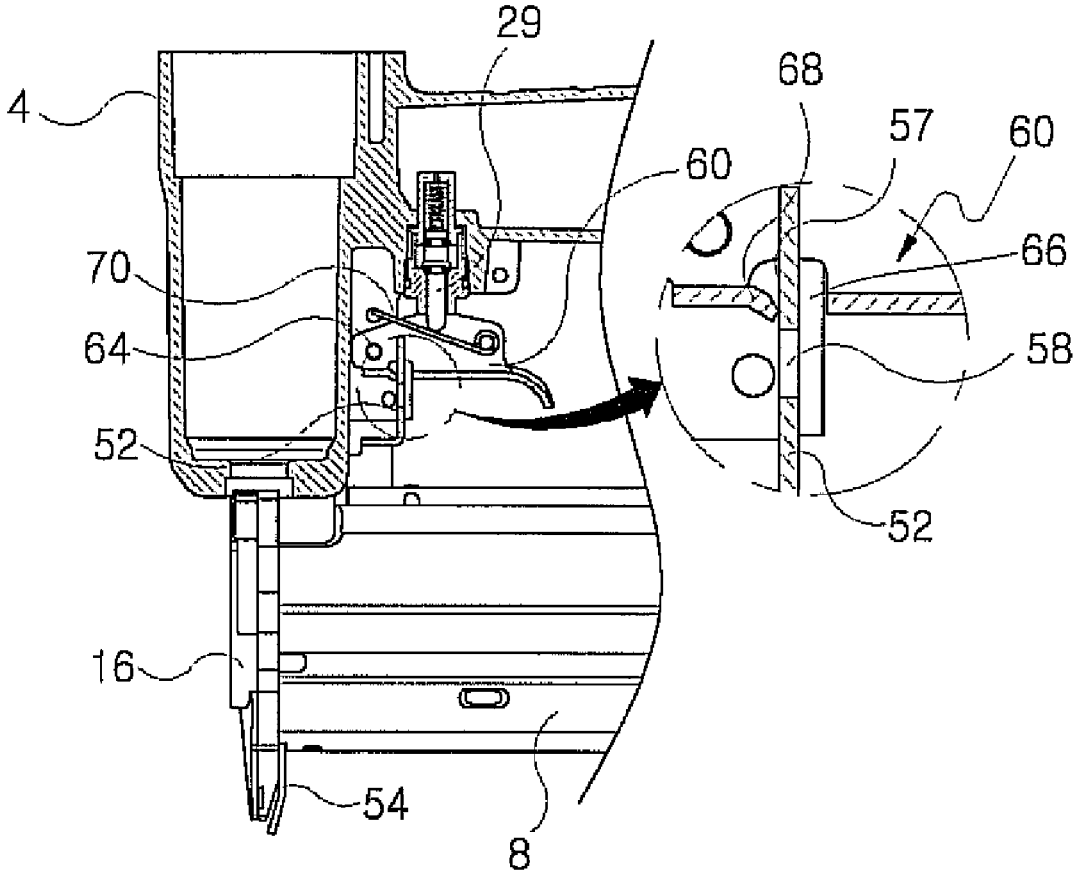
FIGS. 6A, 6B, and 6C are partial side sectional views illustrating the operation of the important parts of the nailer having an improved safety device according to the first embodiment of the present invention.
Figure 6B:
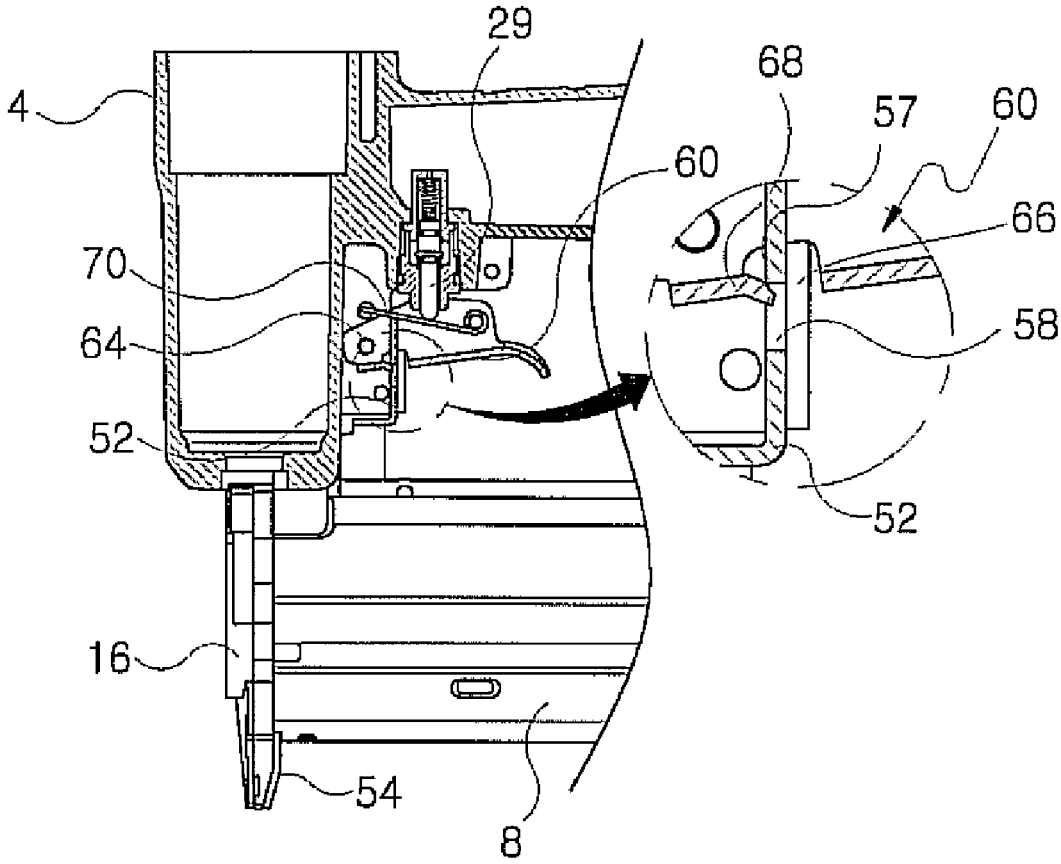
Figure 6C:
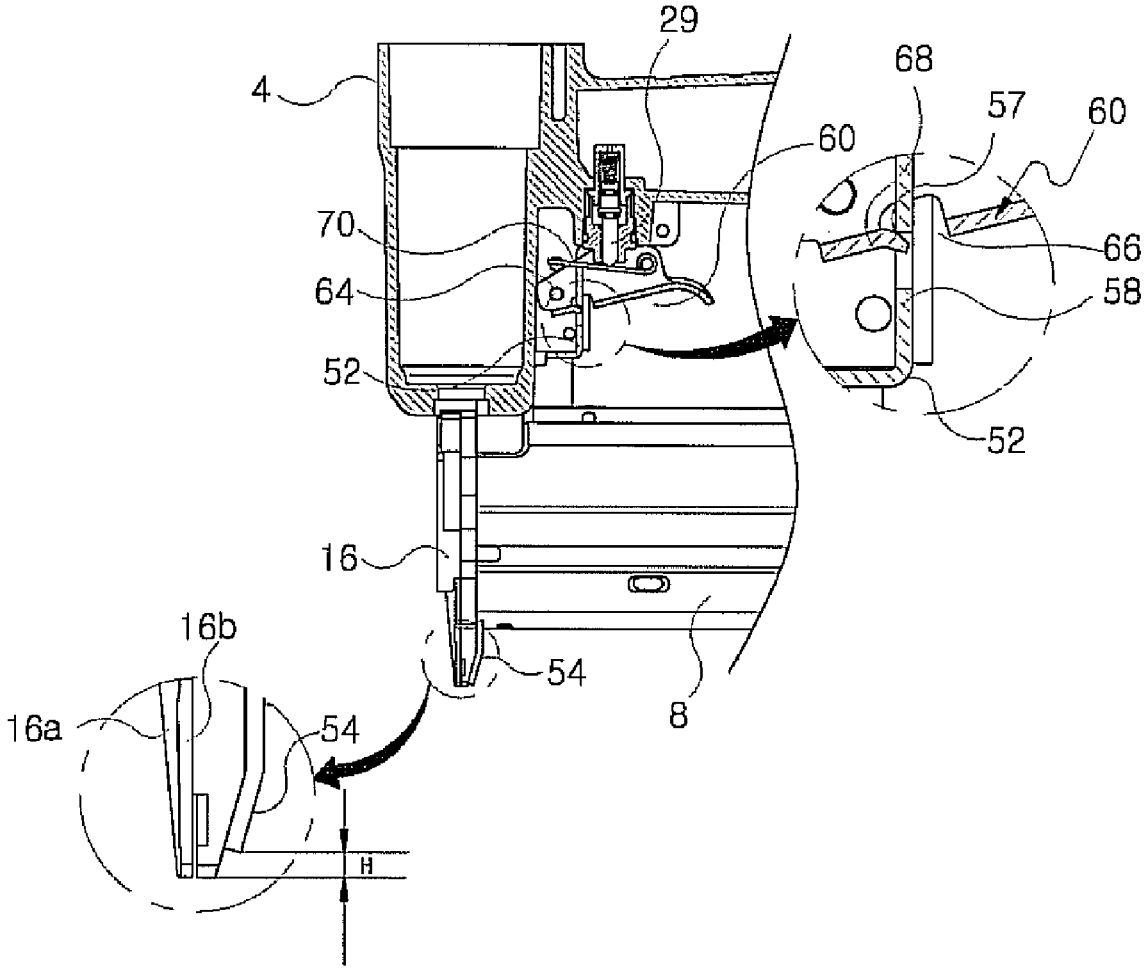
Figure 7:
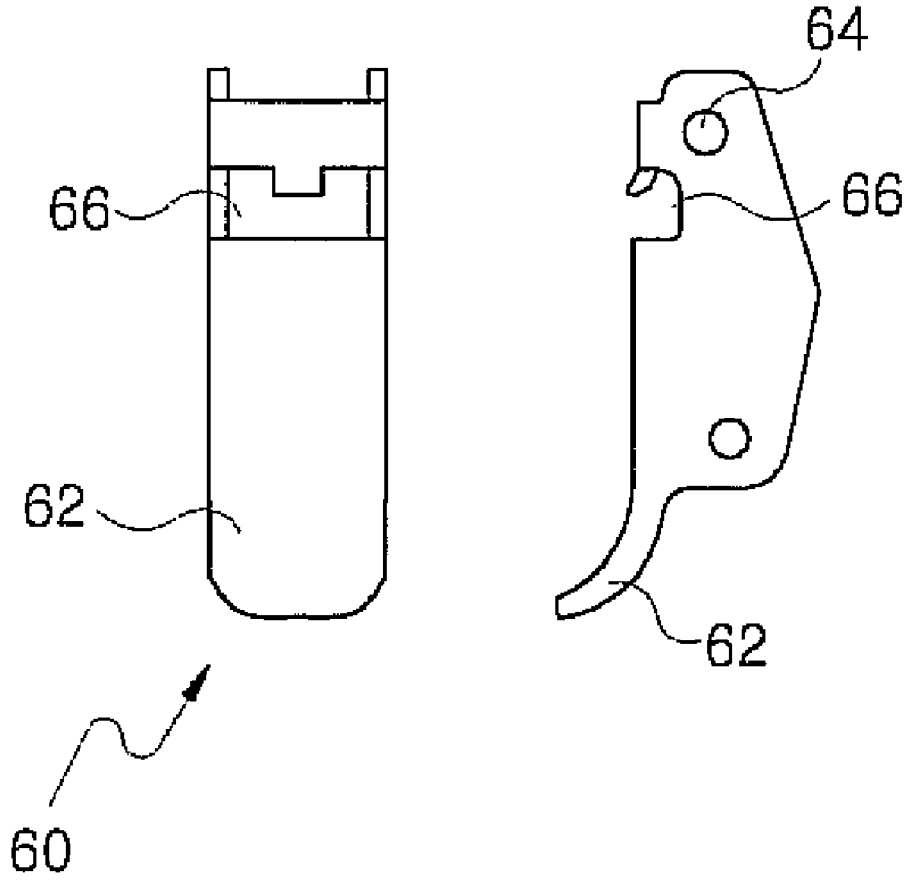
FIG. 7 is a view illustrating a trigger of the nailer having an improved safety device according to the first embodiment of the present invention.

FIGS. 6A, 6B, and 6C are partial side sectional views illustrating the operation of important parts provided in the nailer having the improved safety device according to the first embodiment of the present invention. FIG. 7 is a view illustrating the trigger of the nailer having the improved safety device according to the first embodiment of the present invention.

Referring to the drawings, the nailer 40 having the improved safety device according to the first embodiment of the present invention, as shown in FIG. 6A, is designed in such a manner that the movable plate 52, which is coupled to slide along the lower surface of the guiding unit 16, is not moved toward the handle 12 so long as the contact portion 54 of the safety device, which protrudes forward from a front end of the nailer 40, is not pressed by the specific nailing surface of the target structure.

Thereby, even if the operator pulls the trigger 60, the control protrusion 68, which is formed at the upper end of the inner periphery of the insertion hole 66 formed in the trigger 60, is caught by the retardant portion 57 formed at the rear end of the movable plate 52, thus acting to prevent downward movement of the trigger 60. As a result, the trigger 60 cannot be rotated about a hinge shaft penetrated through the shaft holes 64 to apply a pressure force to the plunger 29, and no projectile objects can be launched from the nailer 40.

On the other hand, in the nailer 40 having the improved safety device according to the first embodiment of the present invention, as shown in FIG. 6B, if the contact portion 54 of the safety device, which protrudes forward from the front end of the nailer 40, is pressed by the specific nailing surface of the target structure, the movable plate 52, which is coupled to the nailer 40 to slidably move along the rear surface of the guiding unit 16, is moved toward the handle 12.

Then, if the trigger 60 is pulled toward the handle 12, the control protrusion 68, which is formed at the upper end of the inner periphery of the insertion recess 66 formed in the trigger 60, is inserted into the insertion hole 53 perforated in the retardant portion 57 of the movable plate 52, thus allowing the trigger 60 to be rotated about the hinge shaft penetrated through the shaft holes 64. As a result, the trigger 60 acts to press the plunger 29, causing the launch of projectile objects, such as nails.

In this case, since the control protrusion 68, which is formed at the upper end of the inner periphery of the insertion hole 66 of the trigger 60, is configured to protrude forward by a predetermined angle, if the trigger 60 is fully pulled after the control protrusion 68 of the trigger 60 is inserted into the insertion hole 58 formed in the movable plate 52, the movable plate 52 is further pulled toward the handle 12 by a predetermined distance H.

As a result, even if the nailer 40 is moved in a state wherein the front end of the guiding unit 16 comes into close contact with the nailing surface of the target structure, there is no risk of causing scratches on the nailing surface by the contact portion 54 of the safety device 50.

Now, a second embodiment of the present invention will be explained in detail with reference to the accompanying drawings.

Figure 8A:
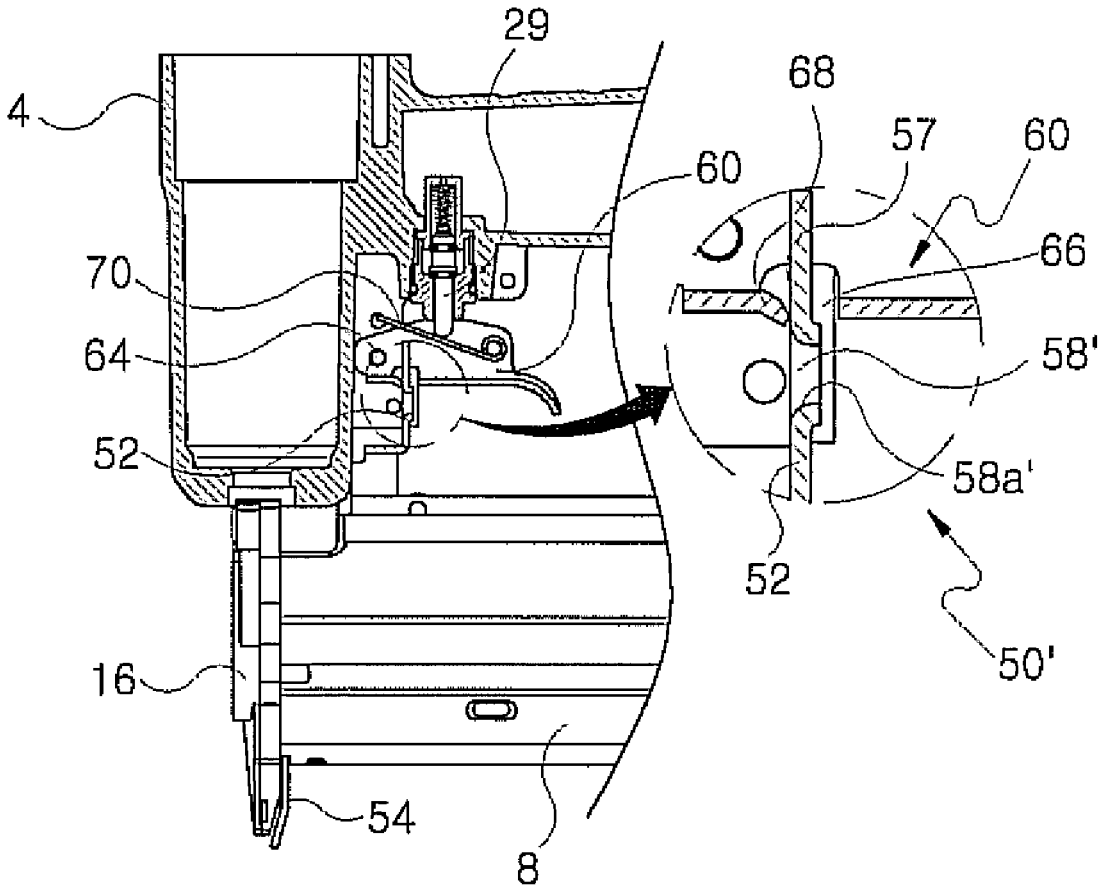
FIGS. 8A, 8B, and 8C are partial side sectional views illustrating the operation of important parts provided in a nailer having an improved safety device according to a second embodiment of the present invention.
Figure 8B:
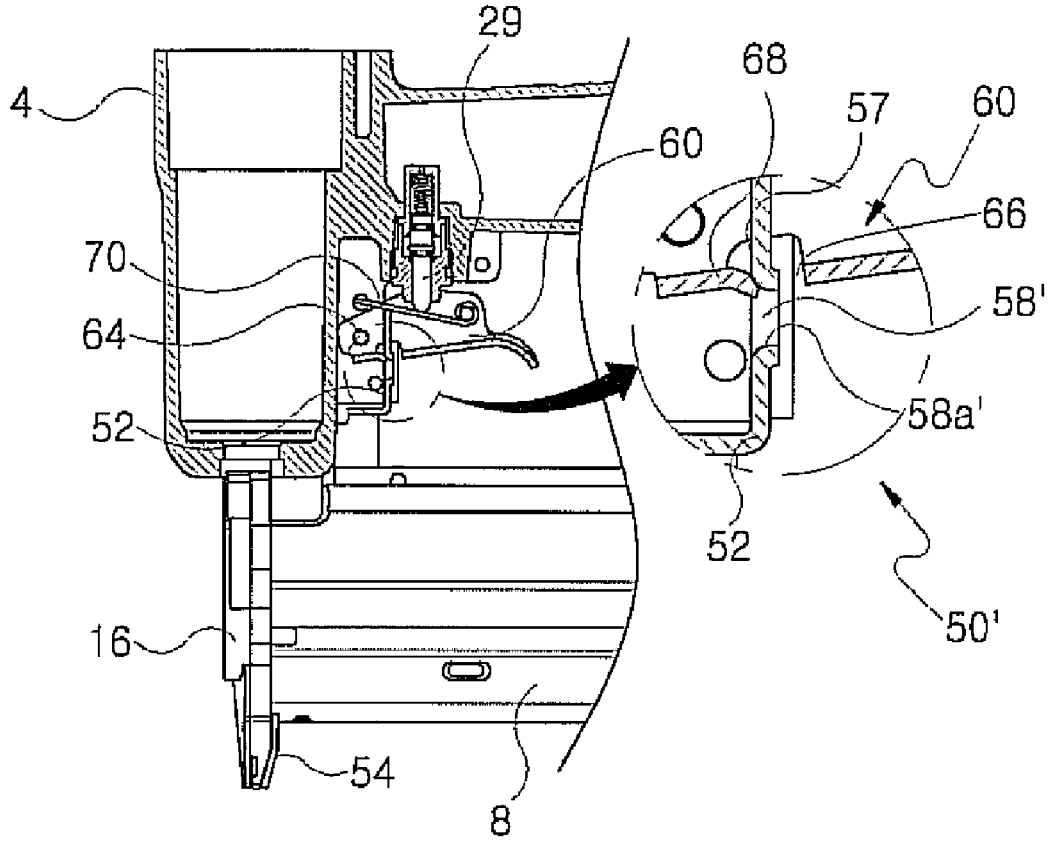
Figure 8C:
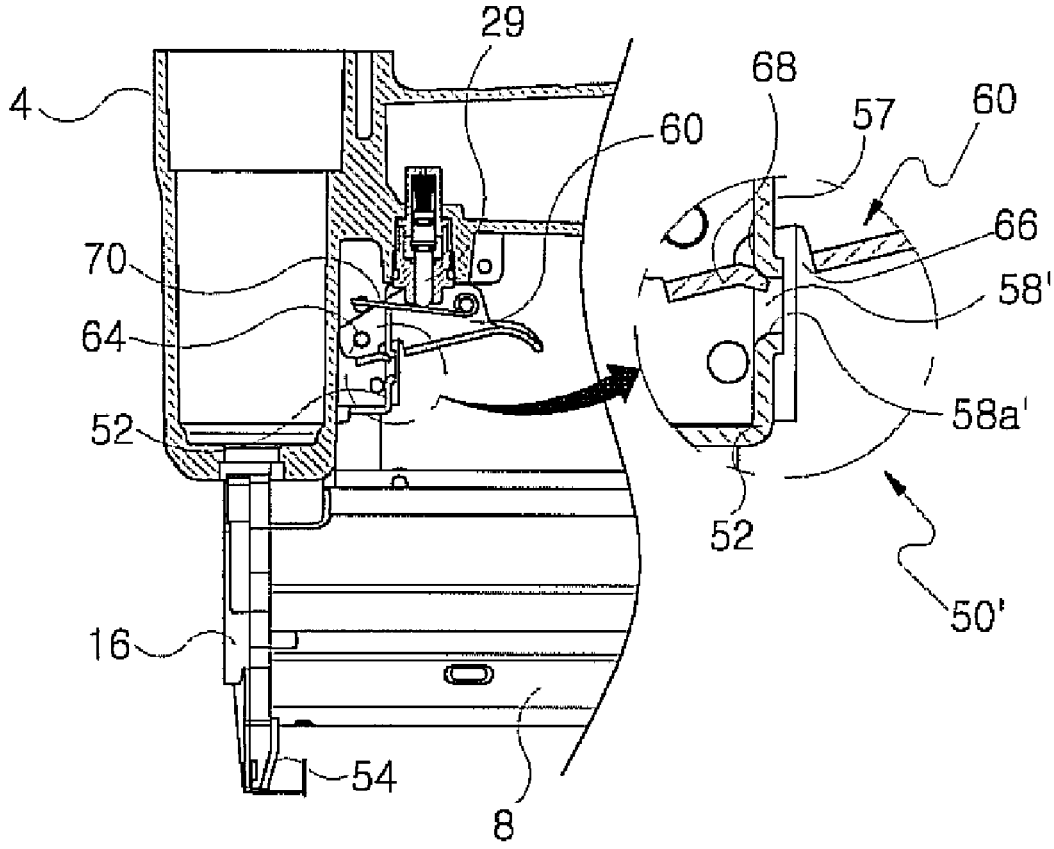

FIGS. 8A, 8B, and 8C are partial side sectional views illustrating the operation of important parts of a nailer having an improved safety device according to the second embodiment of the present invention.

Referring to the drawings, the nailer having the improved safety device according to the second embodiment of the present invention has approximately the same configuration as that of the first embodiment, and repeated description related to the same reference numerals will be omitted.

The nailer having the improved safety device according to the second embodiment of the present invention has a feature in that an insertion hole 58' of the movable plate 52, into which the control protrusion 68 formed at the upper end of the inner periphery of the insertion hole 66 formed in the trigger 60 is inserted, has a rounded inner periphery 58'.

If the trigger 60 is pulled toward the handle 12 in a state wherein the movable plate 52 of a safety device 50' is moved toward the handle 12 as shown in FIG. 8A, the control protrusion 68 formed at the upper end of the inner periphery of the insertion hole 66 of the trigger 60 is adapted to be inserted into the insertion hole 58' perforated in the retardant portion 57 of the movable plate 52 as shown in FIGS. 8B and 8C. In the present embodiment, since the insertion hole 58' has the rounded inner periphery 58*a*', the control protrusion 68 is able to be more easily inserted along the rounded inner periphery 58a' of the insertion hole 58'. Thereby, the trigger 60 is rotated on the basis of the hinge shaft penetrated through the shaft holes 64 of the trigger 60 to thereby press the plunger 29, causing the launch of nails.

Now, a third embodiment of the present invention will be explained in detail with reference to the accompanying drawings.

Figure 9A:
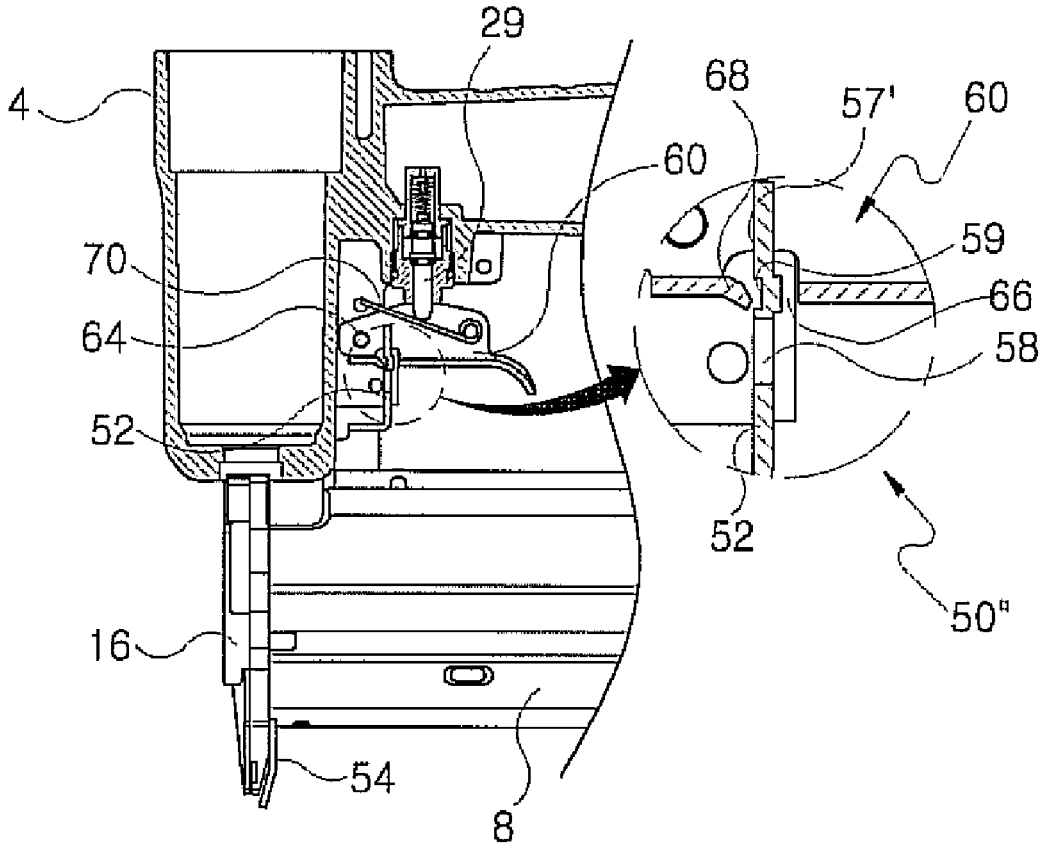
FIGS. 9A, 9B, and 9C are partial side sectional views illustrating the operation of important parts provided in a nailer having an improved safety device according to a third embodiment of the present invention.
Figure 9B:
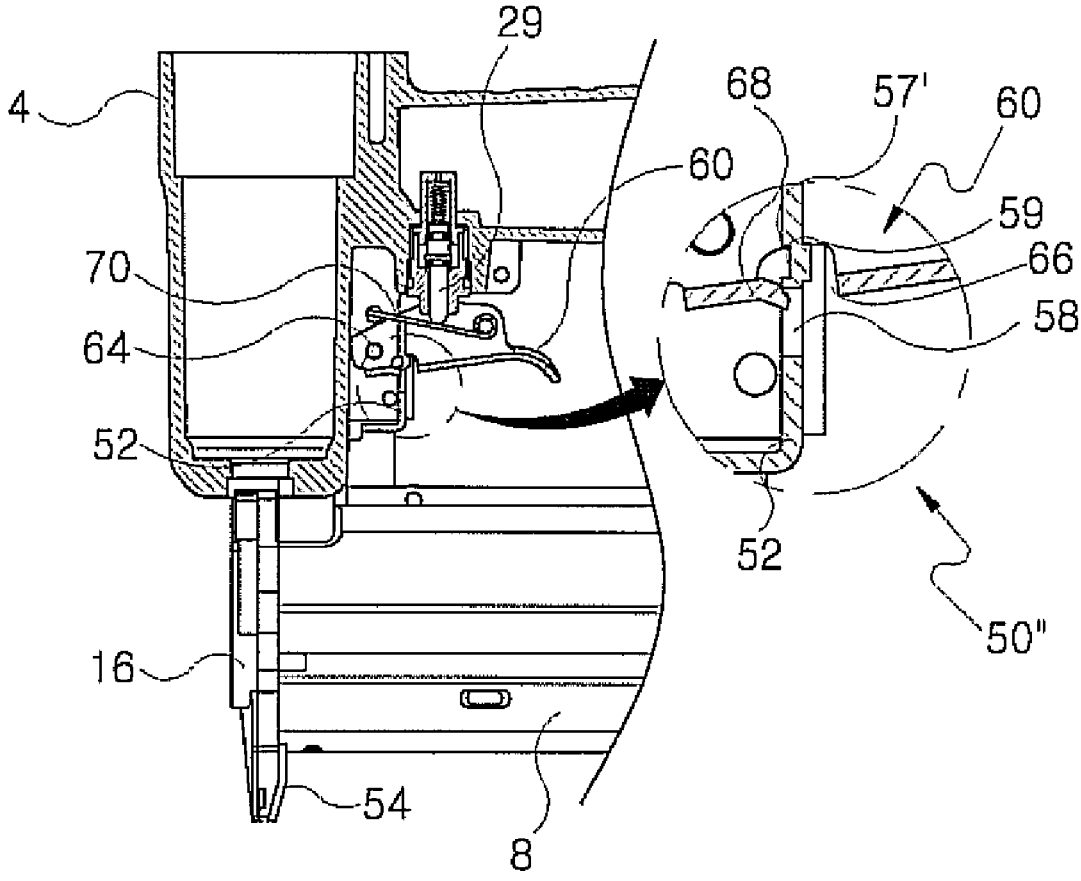
Figure 9C:
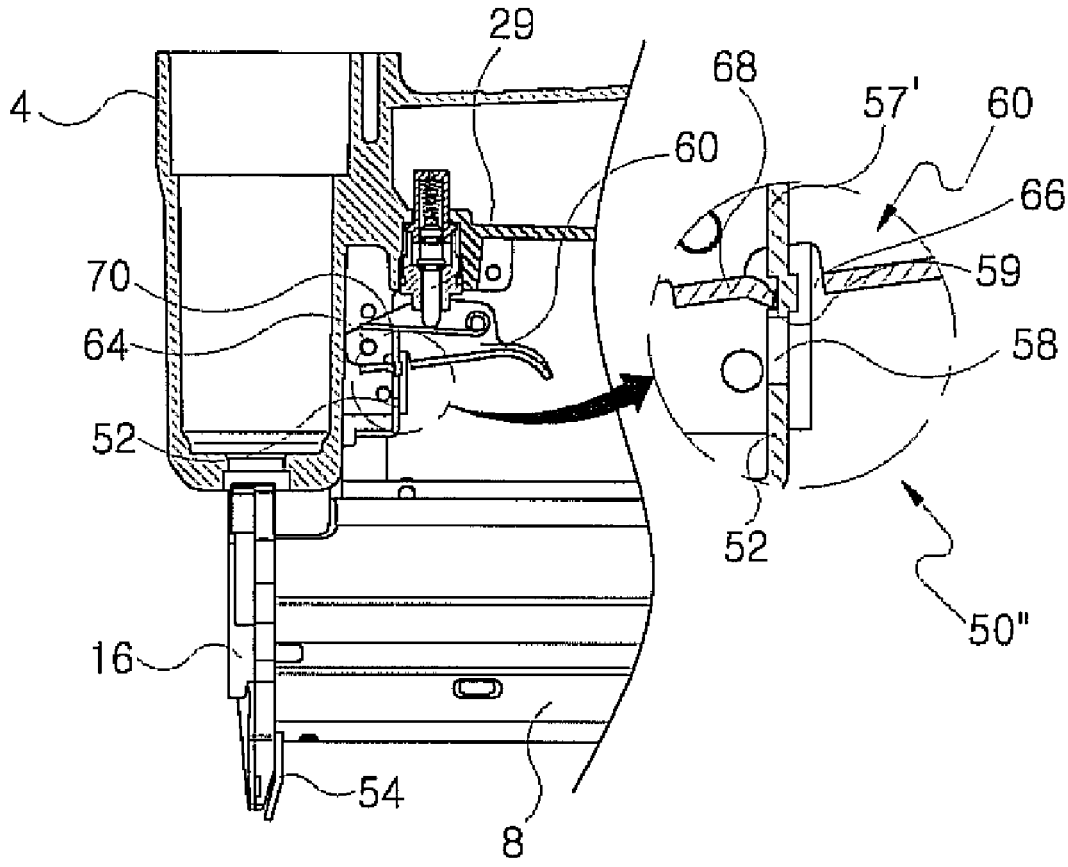

FIGS. 9A, 9B, and 9C are partial side sectional views illustrating the operation of important parts provided in a nailer having an improved safety device according to the third embodiment of the present invention.

In the case of the previously described nailers having the improved safety devices according to the first and second embodiments of the present invention, they perform no nailing operation in a state wherein the movable plate 52 is not moved toward the handle 12 because the movable plate 52 acts to prevent the trigger 60 from being pulled. Also, even when the movable plate 52 of the safety device is pressed toward the handle 12 in the course of pulling the trigger 60, the control protrusion 68 of the trigger 60 comes into contact with the retardant portion 57 formed at the rear end of the movable plate 52, thereby acting to prevent the trigger 60 from being rotated.

However, if the movable plate 52 of the safety device is pressed toward the handle 12 upon receiving an excessively large force applied by the operator in the course of pulling the trigger 60, there is the risk in that the movable plate 52 may be forcibly moved toward the handle 12 by overcoming a frictional force generated when the control protrusion 68 of the trigger 60 comes into contact with the retardant portion 57 formed at the rear end of the movable plate 52. As a result, the protrusion 68 is inserted into the insertion hole 58, thus causing unintentional launch of nails.

To solve the above described problem, the nailer having improved safety device according to the third embodiment of the present invention has a feature in that a retardant portion 57', which is formed at the rear end of the movable plate 52 of a safety device 50", is formed with an insertion recess 59 at a rear side of the insertion hole 58, such that the control protrusion 68 is fitted into the insertion recess 59. Thereby, the insertion recess 59 is able to prevent unintentional movement of the movable plate 52 by the excessive force applied by the operator.

With the above described configuration, if the trigger 60 is pulled in a state wherein the contact portion 54 of the safety device, which protrudes forward from the front end of the nailer 40, is not pressed by the specific nailing surface of the target structure as shown in FIG. 9A, the control protrusion 68 formed at the upper end of the inner periphery of the insertion hole 66 of the trigger 60 is fitted into the insertion groove 59 formed in the retardant portion 57'.

Once the coupling protrusion 68 is fitted in the insertion groove 59, even if the movable plate 52 of the safety device is forcibly pressed toward the handle 12 upon receiving the excessively large force applied by the operator in the course of pulling the trigger 60, the control protrusion 68 of the trigger 60 is not able to be separated from the insertion groove 59. Accordingly, there is no risk of unintentional launch of nails.

On the other hand, in the nailer having the improved safety device according to the third embodiment of the present invention, if the contact portion 54 of the safety device, which protrudes forward from the front end of the nailer 40, is pressed by the specific nailing surface of the target structure, as shown in FIG. 9B, the movable plate 52, which is coupled to the nailer 40 to slidably move along the lower surface of the guiding unit 16, is moved toward the handle 12.

Then, if the trigger 60 is pulled toward the handle 12, the control protrusion 68, which is formed at the upper end of the inner periphery of the insertion recess 66 of the trigger 60, is inserted into the insertion hole 58 perforated in the retardant portion 57 of the movable plate 52. Thereby, the trigger 60 is rotated about the hinge shaft penetrated through the shaft holes 64 to thereby press the plunger 29, causing the launch of nails.

Similarly, since the control protrusion 68, which is adapted to be inserted into the insertion hole 58, is configured to protrude forward by a predetermined angle, if the trigger 60 is fully pulled after the control protrusion 68 of the trigger 60 is inserted in the insertion hole 58 formed in the movable plate 52, the movable plate 52 is further pulled toward the handle 12.

As a result, even if the nailer 40 is moved in a state wherein the front end of the guiding unit 16 comes into close contact with the nailing surface of the target structure, there is no risk of causing scratches on the nailing surface by the contact portion 54 of the safety device 50".

As apparent from the above description, in the nailer having the improved safety device according to the present invention, the movable plate, which is adapted to slidably move along the lower surface of the guiding unit, is formed, at a certain location thereof, with the insertion hole for the insertion of the protrusion formed at the trigger. With this configuration, if the trigger is pulled in a pressed state of the movable plate, a nailing operation can be accomplished. Also, in the course of pulling the trigger, the movable plate can be further moved rearward by a predetermined distance under interaction of the insertion hole and protrusion. This has the effect of eliminating the risk of causing scratches on the nailing surface of the target structure even if the movable plate is moved while coming into close contact, at the front end thereof, with the nailing surface. As a result, the nailer having the improved safety device according to the present invention can achieve several advantages, such as for example, easy nailing operation, operator's convenient working posture, and rapid and safe nailing operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A nailer including a body, a magazine, a guiding unit, a latch, a handle, a plunger, a body cover, and a trigger, the nailer comprising:

a safety device being inserted through the trigger for sliding along a lower surface of the guiding unit, a rear end of said safety device attached perpendicular to the trigger for controlling operation of the trigger, said trigger having a trigger body configured to be pressed by the operator's finger, an insertion hole perforated in a front portion of said trigger body at a position close to an upper end of the front portion to allow a retardant portion of a movable plate to be inserted therethrough, a control protrusion formed at an inner periphery of said insertion hole at an upper end position of an inner periphery thereof, said control protrusion being inserted into the insertion hole perforated in the movable plate, shaft holes perforated through opposite side portions of the trigger body at upper end positions of side portions thereof, and an inner trigger member attached to a rear end portion of the trigger for pressing the plunger when the trigger is pressed.

2. The nailer according to claim 1, wherein the safety device further comprises a multiply-bent movable plate for sliding along the lower surface of the guiding unit, a contact portion formed at a front end of the movable plate for contacting with a target structure, an elongated hole perforated in a central location of the movable plate so that a screw is fastened therethrough to limit a moving distance of the movable plate, said retardant portion formed at a rear end of the movable plate to extend perpendicular to the ground, and said insertion hole perforated in a central location of the retardant portion.

3. The nailer according to claim 1, wherein the control protrusion is configured to protrude forward from the trigger body by a predetermined angle, when the trigger is fully pulled after the control protrusion of the trigger is inserted into the insertion hole perforated in the movable plate, the control protrusion causes the movable plate to be further pulled toward the handle by a predetermined distance, thereby preventing the contact portion of the safety device from causing scratches on a nailing surface even if the nailer is moved in a state wherein a front end of the guiding unit included in the nailer comes into close contact with the nailing surface.

4. The nailer according to claim 3, wherein the insertion hole has formed a rounded inner surface to allow the control protrusion to be inserted along the rounded surface.

5. The nailer according to claim 3, wherein an insertion recess is formed in the retardant portion of the movable plate, to allow the control protrusion to be inserted thereinto.

* * * * *